US010954963B2

(12) United States Patent
Weisbrod et al.

(10) Patent No.: US 10,954,963 B2
(45) Date of Patent: Mar. 23, 2021

(54) TURBOCHARGER

(71) Applicant: MAN DIESEL & TURBO SE, Augsburg (DE)

(72) Inventors: Tobias Weisbrod, Augsburg (DE); Jirí Klima, Namest nad Oslavou (CZ); David Jerabek, Osová Bítýska (CZ); Jan-Christoph Haag, Augsburg (DE); Santiago Uhlenbrock, Gräfenberg (DE); Stefan Rost, Augsburg (DE); Klaus Bartholomä, Friedberg (DE)

(73) Assignee: MAN Energy Solutions SE, Augsburg (DE)

( * ) Notice: Subject to any disclaimer, the term of this patent is extended or adjusted under 35 U.S.C. 154(b) by 220 days.

(21) Appl. No.: 15/712,955

(22) Filed: Sep. 22, 2017

(65) Prior Publication Data

US 2018/0087531 A1 Mar. 29, 2018

(30) Foreign Application Priority Data

Sep. 23, 2016 (DE) ..... 10 2016 117 960.4

(51) Int. Cl.

| | |
|---|---|
| ***F02B 37/00*** | (2006.01) |
| ***F04D 29/62*** | (2006.01) |
| ***F04D 25/02*** | (2006.01) |
| ***F01D 25/24*** | (2006.01) |
| ***F04D 29/056*** | (2006.01) |
| ***F04D 29/42*** | (2006.01) |
| *F04D 25/04* | (2006.01) |

(52) U.S. Cl.

CPC ..... *F04D 29/624* (2013.01); *F01D 25/243* (2013.01); *F04D 25/024* (2013.01); (Continued)

(58) Field of Classification Search

CPC .... F04D 29/624; F04D 25/024; F04D 25/243; F04D 29/4206; F04D 29/056; (Continued)

(56) References Cited

U.S. PATENT DOCUMENTS 666,175 A * 1/1901 Batcheller ..... F16L 23/0283 285/414
1,676,289 A * 7/1928 Schmalz ..... B25B 5/105 269/93

(Continued)

FOREIGN PATENT DOCUMENTS

DE 10 2013 002 605 8/2014
WO WO 2015195332 A1 * 12/2015 ..... F16B 35/04

*Primary Examiner* — Peter J Bertheaud
*Assistant Examiner* — Dnyanesh G Kasture
(74) *Attorney, Agent, or Firm* — Cozen O'Connor

(57) ABSTRACT

A turbocharger, has a turbine for expanding a first medium and a compressor for compressing a second medium. The turbine includes a turbine housing and a turbine rotor. The compressor includes a compressor housing and a compressor rotor coupled to the turbine rotor via a shaft. A bearing housing is arranged between the compressor and turbine housings in which the shaft is mounted. The turbine and bearing housings are connected via a fastening device mounted on a flange of the turbine housing with a first section and a second section that covers a flange of the bearing housing at least in sections. The fastening device is contoured curved on a surface of the second section facing the flange of the bearing housing.

20 Claims, 4 Drawing Sheets

(52) U.S. Cl.
CPC ..... *F04D 29/056* (2013.01); *F04D 29/4206* (2013.01); *F02B 37/00* (2013.01); *F04D 25/04* (2013.01); *F05D 2220/40* (2013.01); *F05D 2240/60* (2013.01); *F05D 2300/506* (2013.01)

(58) Field of Classification Search
CPC .. F04D 25/04; F05D 2240/60; F05D 2220/40; F05D 2300/506; F02B 37/00; F16B 2200/506; F16B 2200/509
See application file for complete search history.

(56) References Cited

U.S. PATENT DOCUMENTS

| | | | | | |
|---|---|---|---|---|---|
| 3,733,575 | A * | 5/1973 | Gottschalk | H01R 4/44 | 439/781 |
| 3,777,796 | A * | 12/1973 | Takano | F16B 39/24 | 411/134 |
| 4,941,787 | A * | 7/1990 | Shaffer | F16B 35/00 | 411/136 |
| 5,451,116 | A * | 9/1995 | Czachor | F01D 9/065 | 403/338 |
| 5,466,105 | A * | 11/1995 | McKay | B60T 8/1893 | 411/84 |
| 2001/0051543 | A1* | 12/2001 | Aoki | F16D 3/78 | 464/19 |
| 2013/0064624 | A1* | 3/2013 | Lee | F16B 39/12 | 411/223 |
| 2015/0061229 | A1* | 3/2015 | Ryther | F16J 15/3224 | 277/375 |
| 2017/0254201 | A1* | 9/2017 | McCall | E21C 35/18 | |
| 2017/0298774 | A1* | 10/2017 | Boeck | F01D 25/243 | |

* cited by examiner

TURBOCHARGER

BACKGROUND OF THE INVENTION

1. Field of the Invention

The invention relates to a turbocharger.

2. Description of the Related Art

DE 10 2013 002 605 A1 discloses a fundamental construction of a turbocharger. A turbocharger comprises a turbine in which a first medium is expanded. Furthermore, a turbocharger comprises a compressor in which a second medium is compressed namely by utilising the energy extracted in the turbine during the expansion of the first medium. The turbine of the turbocharger comprises a turbine housing and a turbine rotor. The compressor of the turbocharger comprises a compressor housing and a compressor rotor. Between the turbine housing of the turbine and the compressor housing of the compressor a bearing housing is positioned, wherein the bearing housing is connected on the one hand to the turbine housing and on the other hand to the compressor housing. In the bearing housing, a shaft is mounted by way of which the turbine rotor is coupled to the compressor rotor.

It is known from practice that the turbine housing of the turbine, namely a so-called turbine inlet housing, and the bearing housing are connected to one another via a fastening device preferentially formed as clamping shoe. Such a fastening device formed as clamping shoe is mounted with a first section of the same on a flange of the turbine housing via a fastener and covers with a second section a flange of the bearing housing at least in sections. By way of such a fastening device, the unit or combination of bearing housing and turbine housing is clamped, in particular by clamping a sealing cover and nozzle ring between turbine housing and bearing housing.

The turbine housing is filled with the first medium to be expanded, in particular with exhaust gas to be expanded. The turbine inlet housing of the turbine housing conducts the exhaust gas in the direction of the turbine rotor. In the turbine inlet housing, there is an overpressure relative to the surroundings, which during the expansion of the first medium, is reduced in the turbine subject to extracting energy. In the region of the joint of turbine housing or turbine inlet housing and bearing housing a leakage can occur so that the first medium to be expanded in the turbine can enter the surroundings via the connecting region between turbine housing and bearing housing. This is disadvantageous.

In order to counteract such a leakage of the first medium to be expanded in the turbine, the clamping between turbine housing or turbine inlet housing and bearing housing is increased according to practice, in particular by way of higher tightening torques for the fastening, via which the fastening device preferentially formed as clamping shoe is mounted on the turbine housing. Because of this, a clamping force between the fastening device and the bearing housing also increases. As a consequence of the different thermal expansions of bearing housing and turbine housing or turbine inlet housing, a contact point between the bearing housing and the fastening device is exposed to high relative movements. In conjunction with a high contact pressure or a high preload or a high clamping force between the bearing housing and the fastening device, a wear on the fastening device and/or on the bearing housing can then occur as a consequence of a so-called digging effect. Because of this, a leakage of the first medium to be expanded in the turbine into the surroundings can then be brought about while in an extreme case the connection of turbine housing or turbine inflow housing and bearing housing can work loose.

SUMMARY OF THE INVENTION

Starting out from this, the present invention is based on creating a new type of turbocharger.

The fastening device is contoured curved on a surface of the second section facing the flange of the bearing housing. Through the curved contouring of the fastening device on the surface facing the flange of the bearing housing, a defined tribological surface form is provided on the fastening device which, upon a relative movement between fastening device and bearing housing, minimises a wear on fastening device and bearing housing.

Because of this, the risk of a leakage of the first medium to be expanded in the turbine into the surroundings is reduced. Furthermore, the risk that the connection of bearing housing and turbine housing comes apart is reduced.

Preferentially, a curvature radius of the curved surface of the second section of the fastening device facing the flange of the bearing housing corresponds to between 5 times and 20 times the axial thickness of the fastening device in the region of the second section and/or first section. Such a curvature radius of the curved surface of the fastening device provides a particularly advantageous tribological surface form for wear minimisation.

Preferentially, the fastening device consists of a material with a hardness of at least 40 HRC or of a hardened material with a surface hardness in the region of the curved surface of at least 40 HRC. In particular when the fastening device is embodied in such a manner, the risk of wear on fastening device and bearing housing can be further reduced.

According to an advantageous first further development of the invention, at least one ring is arranged between the second section of the fastening device and the flange of the bearing housing. By arranging at least one ring between the second section of the fastening device and the flange of the bearing housing, the risk of wear on fastening device and bearing housing can be further reduced. In particular, the or each ring in this case has a surface hardness of at least 40 HRC, for the purpose of which the respective ring is produced either from a material with this hardness or is hardened on the surface providing this hardness.

Preferentially, two rings are arranged between the second section of the fastening device and the flange of the bearing housing, wherein a first ring lies on a first side against a flange of the bearing housing, wherein a second ring lies with a first side against the second section of the fastening device, wherein the two rings lie against one another with two sides. In particular, the first ring has a thermal expansion coefficient which corresponds to the thermal expansion coefficient of the bearing housing, wherein the second ring has a thermal expansion coefficient deviating from this. By arranging two rings axially one behind the other in such a manner between the second section of the fastening device and the flange of the bearing housing, the risk of wear for bearing housing and fastening device can be particularly advantageously reduced. Here it is particularly advantageous when the first ring, which with its first side lies against the flange of the bearing housing, has a thermal coefficient which corresponds to the thermal expansion coefficient of the bearing housing. Because of this, a relative movement between the first ring and the bearing housing is minimised.

The second ring, which with its first surface lies against the second section of the fastening device, has a deviating thermal expansion coefficient in order to shift a relative movement forming during the operation between the contact surfaces of the two rings.

According to a second alternative further development of the invention, the flange of the bearing housing is embodied as separate assembly of the bearing housing, produced from a hard or hardened material with a surface hardness of at least 40 HRC and mounted on a basic body of the bearing housing by means of a thread. By way of this, a risk of wear of the connection between bearing housing and turbine housing can also be reduced.

According to a third likewise alternative further development of the invention, the flange, which is embodied as integral assembly of the bearing housing, is hardened on a surface facing the second section of the fastening device and on this surface has a surface hardness of at least 40 HRC. This embodiment of the invention also allows reducing the risk of wear of the connection between bearing housing and turbine housing.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Exemplary embodiments of the invention are explained in more detail by way of the drawing without being restricted to this. There it shows.

DETAILED DESCRIPTION OF THE PRESENTLY PREFERRED EMBODIMENTS

The invention relates to a turbocharger. A turbocharger comprises a turbine for expanding a first medium, in particular for expanding exhaust gas of an internal combustion engine. Furthermore, a turbocharger comprises a compressor for compressing a second medium, in particular charge air, namely utilising energy extracted in the turbine during the expansion of the first medium. Here, the turbine comprises a turbine housing and a turbine rotor. The compressor comprises a compressor housing and a compressor rotor. The compressor rotor is coupled to the turbine rotor via a shaft, which is mounted in a bearing housing, wherein the bearing housing is positioned between the turbine housing and the compressor housing and connected both to the turbine housing and the compressor housing. The person skilled in the art addressed here is familiar with this fundamental construction of a turbocharger.

The invention now relates to such details of a turbocharger which relate to the connection of turbine housing and bearing housing. Making reference to FIGS. 1 to 6, different exemplary embodiments of turbochargers are described in the following, wherein FIGS. 1 to 6 each show corresponding extracts from a turbocharger in the region of the connection of the turbine housing to the bearing housing.

Figure 1:
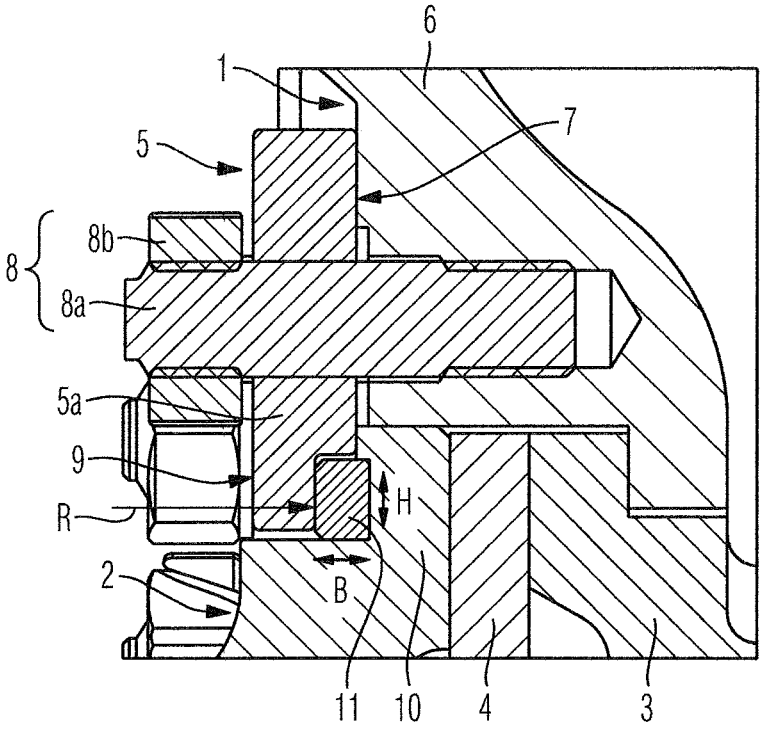
FIG. 1: is a cross section by way of an extract through a first turbocharger in the region of a connection of a turbine housing to a bearing housing.
Figure 2:
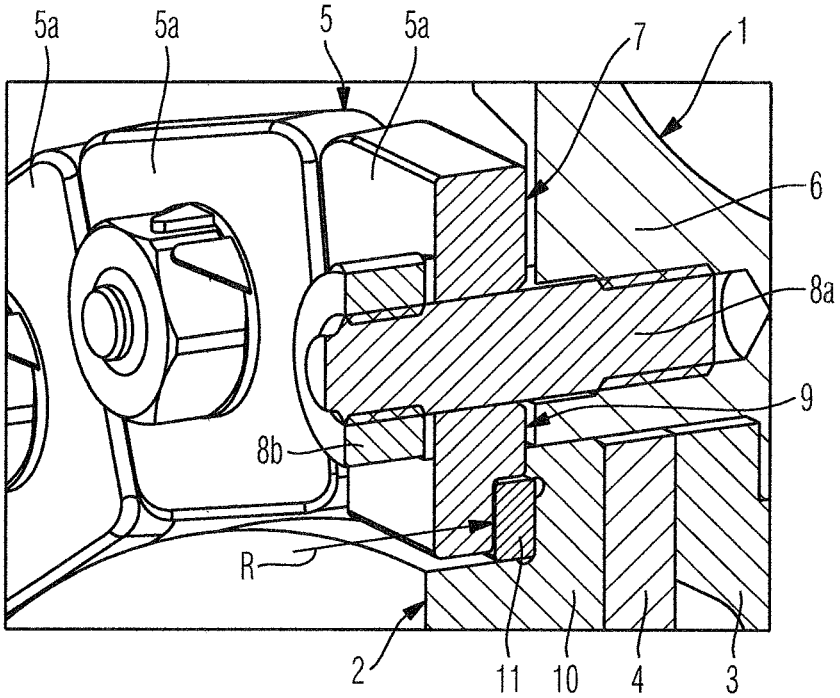
FIG. 2: is a perspective view of FIG. 1.

A first exemplary embodiment of a turbocharger is shown by FIGS. 1 and 2, wherein in FIGS. 1 and 2 the joint between a turbine housing, namely a turbine inlet housing 1 of the turbine housing, and a bearing housing 2 of the exhaust gas turbocharger is shown. Furthermore, FIG. 1 shows a nozzle ring 3 and a sealing cover 4.

The turbine inlet housing 1 is connected to the bearing housing 2 via a fastening device 5 in such a manner that the fastening device 5 is mounted on a flange 6 of the turbine inlet housing 1 with a first section 7, namely via a plurality of fastening elements 8, and that the fastening device 5 with a second section 9 covers a flange 10 of the bearing housing 2 at least in sections. The fastening device 5 is also called a clamping shoe. In the exemplary embodiment of FIGS. 1 and 2, the fastening device 5 is segmented seen in circumferential direction, wherein each individual segment 5*a* of the fastening device 5 is mounted to the flange 6 of the turbine inlet housing 1 via a fastening elements 8 each via the respective first section 7. Preferentially, maximally two such fastening elements 8 are provided for each segment 5*a* of the fastening device 5 in order to mount the respective segment 5*a* to the flange 6 of the turbine inlet housing 1.

In the exemplary embodiment shown in FIGS. 1 and 2, each fastening elements 8 comprises a threaded screw 8*a* screwed into the flange 6 of the turbine inlet housing 1 and a nut 8*b* acting on the other end of the threaded screw 8*a*, wherein by tightening the nuts 8*b* a defined preload force can be applied onto the turbine inlet housing 1 and onto the bearing housing 10 via the fastening device 5. In the process, corresponding flanges of nozzle ring 3 and sealing cover 4 are clamped between turbine inlet housing 1 and bearing housing 2.

In order to minimise a leakage flow via this connecting region of turbine inlet housing 1 and bearing housing 2 it has to be avoided that in particular the fastening device 5 is subjected to a wear so that a defined clamping force can always be applied onto turbine inlet housing 1 and bearing housing 2 and there is no risk that the turbine inlet housing 1 and the bearing housing 2 work loose.

The fastening device 5 according to the invention has a curved contouring on a surface of the second section 9 of the bearing housing 2 facing the flange 10 of the same. Here, this curved contoured surface of the second section 9 of the fastening device 5 facing the flange 10 of the bearing housing 2 is convexly curved towards the outside, namely with a curvature radius R which corresponds between 5 times and 20 times the axial thickness of the fastening device 5 in the region of the second section 9 and/or of the first section 7 of the fastening device. In the exemplary embodiment of FIGS. 1 and 2, in which the fastening device 5 is formed by a plurality of segments 5*a*, each segment 5*a* has such a curvature in the region of the surface of the respective second section 9 facing the flange 10 of the bearing housing 2.

By way of the curved contouring of the fastening device 5 or of the segments 5*a* of the fastening device 5 on the surface of the second section 9 facing the flange 10 of the bearing housing 2 described above, a tribological form is provided on this surface which in particular when during the operation relative movements between turbine inlet housing and bearing housing and thus between fastening device 5 and bearing housing 2 form, minimises a risk of wear on the bearing housing 2 and on the fastening device 5.

The fastening device 5 or the segments 5*a* of the same preferentially consist of a metallic material with a hardness of at least 40 HRC (Rockwell hardness of scale C), or the fastening device 5 or the segments 5*a* consist of a hardened metallic material with a surface hardness in the region of the curved surface of at least 40 HRC. The hardening of a metallic material for providing such a surface hardness is preferentially effected by nitriding. It is likewise possible for hardening a metallic material to apply a coating to a surface to be hardened, for example by way of a melting or spraying method, such as for example laser cladding.

The combination of the curved contouring of the fastening device in the region of the surface of the second section 9 of the fastening device 5 facing the flange 10 of the bearing housing 2 combined with the hardness of the fastening device 5 described above reduces the risk of wear in the case that relative movements during the operation form between fastening device 5 and bearing housing 2. In particular, the so-called digging effect can be prevented.

In the exemplary embodiment of FIGS. 1 and 2, a ring 11 is arranged between the flange 10 of the bearing housing 2 and the second section 9 of the fastening device 5 or of the segments 5*a* of the fastening device 5. In the exemplary embodiment of FIGS. 1 and 2, a single ring 11 is positioned here between the flange 10 of the bearing housing 2 and the second section 9 of the respective segment 5*a* of the fastening device 5, wherein this ring 11 has an axial width B and a radial height H. In order to avoid a tilting of the ring 11 as a consequence of friction forces acting on the ring, a ratio is $B:H \leq 0.25$. Preferentially, the ring 11 consists of a material with a hardness of at least 40 HRC or of a hardened material with a surface hardness of at least 40 HRC. This serves for the wear minimisation upon occurrence of a relative movement between the fastening device 5 and the bearing housing 2.

In the exemplary embodiment of FIGS. 1 and 2, in which a single ring 11 is arranged between the flange 10 of the bearing housing 2 and the second section 9 of the fastening device 5 or of the segments 5*a* of the fastening device 5, the ring 11 has a thermal expansion coefficient that approximately corresponds to the thermal expansion coefficient or the thermal expansion coefficient of the bearing housing 2. Because of this, relative movements between the ring 11 and the bearing housing 2 are minimised, relative movements take place between the ring 11 and the segments 5*a* of the fastening device 5. The surfaces of ring 11 and the second section 9 of the segments 5*a* of the fastening device 5 lying against one another have a surface hardness of preferentially more than 40 HRC, the surface of the second section 9 of the segments 5*a* of the fastening device 5 facing the ring 11 has the contoured curvature with the curvature radius R described above, as a result of which an altogether low-wear mounting of the bearing housing 2 on the turbine housing 1, namely on the turbine inlet housing is possible.

The ring 11 of the exemplary embodiment of FIGS. 1 and 2 is preferentially slit in a circumferential position subject to forming an open ring so that the same can be easily turned onto or threaded onto the flange 10 of the bearing housing 2. This is required in particular when the flange of the bearing housing 2, interacting with the compressor housing which is not shown, has a larger diameter than the shown flange 10 of the bearing housing 2 interacting with the turbine inlet housing 1. The ring 10 of FIGS. 1 and 2 lies with a first side against the flange 10 of the bearing housing 2 and with a second side against the second section 9 of the segments 5*a* of the fastening device 5.

Figure 3:
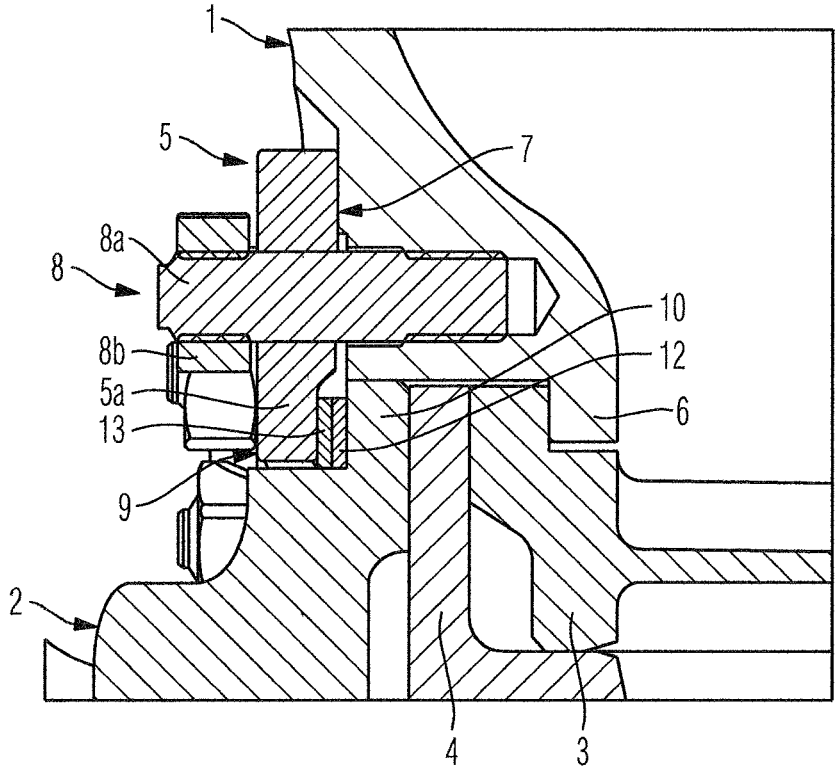
FIG. 3: is a cross section by way of an extract through a turbocharger in the region of a connection of a turbine housing to a bearing housing.
Figure 4:
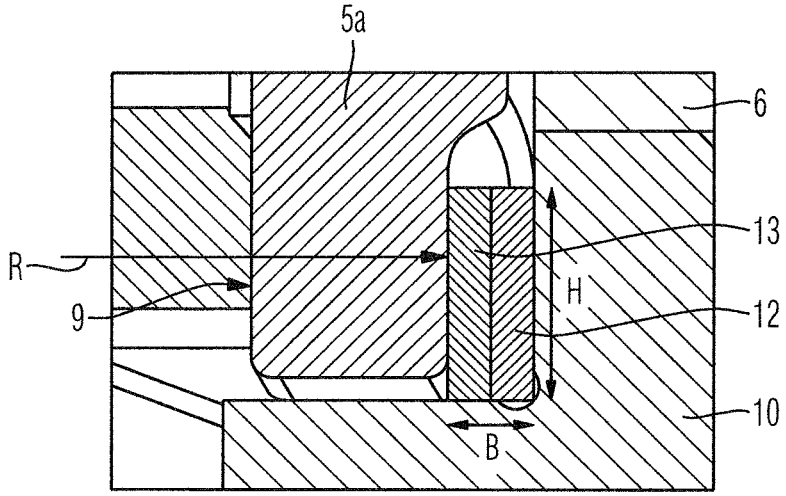
FIG. 4: is a detail of FIG. 3.

A particularly preferred exemplary embodiment of a turbocharger is shown by FIGS. 3 and 4, wherein the exemplary embodiment of FIGS. 3 and 4 primarily differs from the exemplary embodiment of FIGS. 1 and 2 in that in the exemplary embodiment of FIGS. 3 and 4 it is not a single ring 11 that is arranged between the flange 10 of the bearing housing 2 and the second section 9 of the fastening device 5 or the second section 9 of the segments 5*a* of the fastening device 5, but two rings 12 and 13 are arranged here axially one behind the other in FIGS. 3 and 4. Here, a first ring 12 lies with a first side against the flange 10 of the bearing housing 2 whereas a second ring 13 of a first size against the second section 9 of the fastening device 5 or of the segments 5*a* of the fastening device 5. Furthermore, the two rings 12 and 13 lie against one another with second sides facing one another.

The first ring 12 preferentially has a thermal expansion coefficient that corresponds to the thermal expansion coefficient of the bearing housing 2. The second ring 13 preferentially has a thermal expansion coefficient deviating from this. Because of this it is possible to shift a relative movement that can develop during the operation between the two rings 12, 13. This allows a particularly low-wear connection of the bearing housing 2 to the turbine inlet housing 1.

In the exemplary embodiment of FIGS. 3 and 4, the second section 9 of the fastening device 5 or of the segments 5*a* of the fastening device 5 is also contoured curved on the side facing the second ring 13 and thus the flange 10 of the bearing housing 2, namely as described in connection with FIGS. 1 and 2, with a defined curvature radius R. In this regard, reference is made to the above explanations. The arrangement of the two rings 12 and 13 has an axial width B and a radial height H, wherein a ratio is $B:H \leq 0.25$.

The two rings 12, 13 preferentially consist of a material with a hardness of at least 40 HRC or of a hardened material with a surface hardness of at least 40 HRC.

The first ring 12, which with its first side lies against the flange 10 of the bearing housing 2, is preferentially slit in a single circumferential position so that the same can again as a unit be simply threaded onto the bearing housing 2, namely the flange 10 of the same. The second ring 13, by contrast, is preferentially slit in a plurality of circumferential positions subject to forming a plurality of ring segments preferentially in such a manner that the number and thus circumferential extent of the ring segments of the second ring 13 corresponds to the number and thus circumferential extent of the segments 5*a* of the fastening device 5.

Between each segment 5*a* of the fastening device 5 and the flange 10 of the bearing housing 2 an individual ring segment of the second ring 13 is preferentially positioned in each case, wherein all ring segments of the second ring segment 13 then lie against the first ring 12 which is slit in a circumferential position and formed as open ring. Through the segmenting of the second ring 13, thermal stresses in circumferential direction can be reduced. A sliding movement is then divided into a plurality of series-connected sliding surfaces of the ring segments of the ring 13, as a result of which a friction force acting on the fastening device 5 is reduced.

Figure 5:
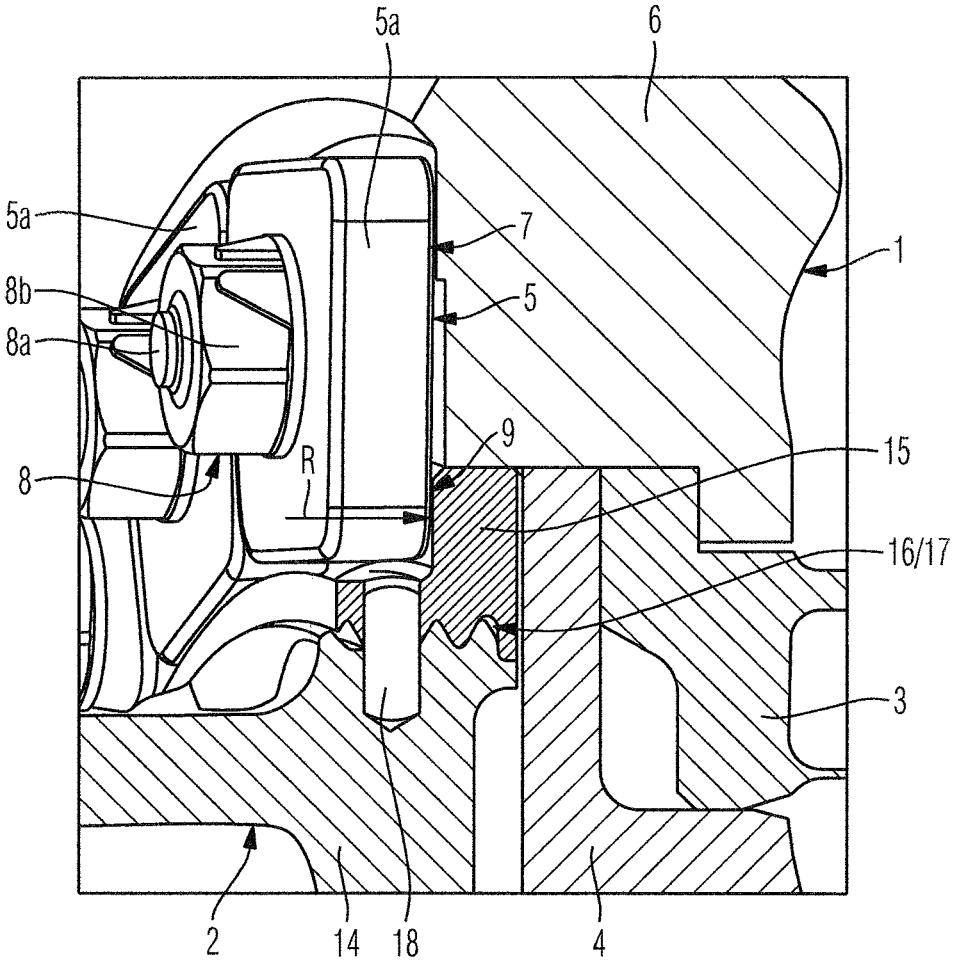
FIG. 5: is a cross section by way of an extract through a turbocharger in the region of a connection of a turbine housing to a bearing housing.

A further exemplary embodiment of a turbocharger according to the invention is shown by FIG. 5, wherein FIG. 5 represents an alternative to the exemplary embodiments of FIGS. 1 to 4. In the exemplary embodiment of FIG. 5 it is provided that the bearing housing 2 is formed at least in two parts and comprises a basic body 14, with which a separate flange 15 is connected. The basic body 14 is produced from a conventional metallic material whereas the separate flange 15, which is fastened with the basic body 14, is produced from a material having a hardness of at least 40 HRC, or which is produced from a hardened material having a surface hardness of at least 40 HRC. Because of this, adapted friction coefficients are provided between the flange 15 of the bearing housing 2 and the fastening device 5, namely the segments 5*a* of the same, in the region of the second sections 9 of the same, in order to minimise a wear of the connection between bearing housing 2 or turbine inlet housing 1. Here it is again provided also in FIG. 5 that the second section 9 of the fastening device 5 or the second section 9 of the segments 5*a* of the fastening device 5 is convexly curved to the outside with a defined curvature radius R on the side facing the flange 15 of the bearing housing 2. With respect to these characterising features, reference is made to the above explanations regarding the exemplary embodiment of FIGS. 1 and 2 and to the exemplary embodiment of FIGS. 3 and 4.

The main difference to the exemplary embodiment of FIG. 5 and the exemplary embodiment of FIGS. 1 to 4 accordingly consists in that in FIG. 5 no ring is provided which is positioned between the flange 10 of the bearing housing 2 and the fastening device 5, but the flange 15 of the bearing housing 2 is produced here as separate assembly from a hard or hardened metallic material.

From FIG. 5 it is evident that this separate flange 15 produced from a hard or hardened material is screwed onto the basic body 14 of the bearing housing 2, wherein for this purpose an internal thread 16 on the flange 15 interacts with an external thread 17 on the basic body 14 of the bearing housing 2. Such a screw connection is preferred since the same constitutes a form-fit and is thus insensitive to thermal expansions and production tolerances. According to FIG. 5 it is provided to lock the screw connection between the flange 15 of the bearing housing 2 and the basic body 14 of the bearing body 2 via at least one locking element 18 extending in radial direction, which in the shown exemplary embodiment is embodied as cylindrical pin.

Figure 6:
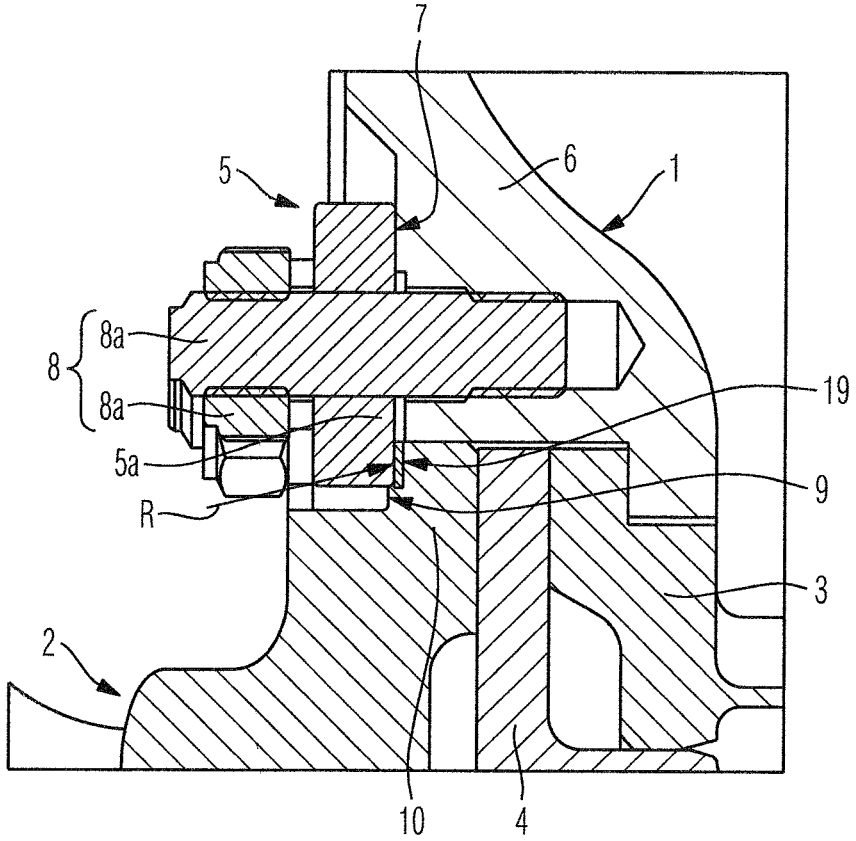
FIG. 6: a cross section by way of an extract through a fourth turbocharger in the region of a connection of a turbine housing to a bearing housing.

A further exemplary embodiment of a turbocharger according to the invention is shown by FIG. 6. In the exemplary embodiment of FIG. 6 it is provided that the bearing housing 2 is hardened in the region of the flange 10, namely in the region of a surface of the flange 10, which with the convexly curved surface of the fastening device 5 or of the respective segment 5*a* of the fastening device 5 interacts on the second section 9 of the same. FIG. 6 shows a coating 19 applied onto this surface of the flange 10 of the bearing housing 2 in order to harden the bearing housing 2 on this surface of the flange 10, wherein this coating can be applied for example by way of a melting or spraying method such as laser cladding. Alternatively to a coating, the material of the bearing housing 2 can also be hardened by way of a hardening method such as for example laser hardening or nitriding.

With all versions of an exhaust gas turbocharger according to the invention, a particularly advantageous connection between turbine inlet housing 1 and bearing housing 2 can be provided, which is low-wear. Particularly preferred is the embodiment of FIGS. 3 and 4, with which between the flange 10 of the bearing housing 2 and the sections 9 of the segments 5*a* of the fastening device 5 covering the flange 10 of the bearing housing 2, two rings 12 and 13 are arranged axially one behind the other. This embodiment is not only simple in design but this embodiment also allows a shifting of relative movements due to the operation between the two rings 12 and 13, so that both the fastening device 5 and also the bearing housing 2 are not exposed to any wear as a result of which there is no risk that a leakage flow of the first medium to be expanded in the turbine enters the surroundings or even the connection between turbine inlet housing 1 and bearing housing 2 works loose.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A turbocharger, comprising:

a shaft a turbine configured to expand a first medium, comprising:

a turbine housing; and a turbine rotor;

a compressor configured to compress a second medium utilizing energy extracted in the turbine during an expansion of the first medium, comprising:

a compressor housing; and a compressor rotor coupled to the turbine rotor via the shaft;

a bearing housing arranged between and connected to the turbine housing and the compressor housing, and in which the shaft is mounted; and a fastening device having a first planar face and a second face opposite the first planar face comprising a first planar section and a nonplanar second section, the fastening device configured to connect the turbine housing and the bearing housing, wherein the fastening device is mounted at least partially directly on a planar flange of the turbine housing with the first planar section by at least one fastener arranged on the first planar face and wherein the nonplanar second section at least partially contacts a planar flange of the bearing housing, wherein the first planar face of the fastening device faces away from the planar flange of the bearing housing and the flange of the turbine housing, and the fastening device is convexly curved on a surface of the nonplanar second section facing the planar flange of the bearing housing.

2. The turbocharger according to claim 1, wherein a curvature radius of the curved surface of the second section of the fastening device facing the flange of the bearing housing is between 5 times and 20 times an axial thickness of the fastening device in a region of at least one of the second section and first section.

3. The turbocharger according to claim 2, wherein the fastening device includes one of:

a material having a hardness of at least 40 HRC and a hardened material having a surface hardness in the region of the curved surface of at least 40 HRC.

4. The turbocharger according to claim 1, further comprising:

at least one planar ring arranged between the second section of the fastening device and the flange of the bearing housing.

5. The turbocharger according to claim 1, further comprising:

a single planar ring arranged between the second section of the fastening device and the flange of the bearing housing, wherein a first planar side of the single ring lies against the flange of the bearing housing and a second planar side of the single ring lies against the second section of the fastening device.

6. The turbocharger according to claim 4, wherein the at least one ring has a coefficient of thermal expansion that corresponds to a coefficient of thermal expansion of the bearing housing.

7. The turbocharger according to claim 1, further comprising:

two planar rings arranged between the second section of the fastening device and the flange of the bearing housing, wherein a first ring with a first planar side lies against the flange of the bearing housing, wherein a second ring with a first planar side lies against the second section of the fastening device, wherein the two rings have respective second sides that face each other.

8. The turbocharger according to claim 7, wherein the first ring has a coefficient of thermal expansion that corresponds to a coefficient of thermal expansion coefficient of the bearing housing, and the second ring has a coefficient of thermal expansion coefficient different than the coefficient of thermal expansion of the first ring.

9. The turbocharger according to claim 4, wherein the at least one ring has an axial width B and radial height H, wherein a ratio is $B/H \leq 0.25$.

10. The turbocharger according to claim 4, wherein the at least one ring comprises at least one of:

a material having a hardness of at least 40 HRC and a hardened material having a surface hardness of at least 40 HRC.

11. The turbocharger according to claim 4, wherein the at least one ring is slit in at least one circumferential position.

12. The turbocharger according to claim 7, wherein the first ring is slit in a single circumferential position forming a discontinuous ring and the second ring is slit in a plurality of circumferential positions subject to forming a plurality of ring segments.

13. The turbocharger according to claim 4, wherein the at least one ring is slit in a single circumferential position forming a discontinuous ring.

14. The turbocharger according to claim 1, wherein the flange of the bearing housing is an integral assembly of the bearing housing and is hardened to a hardness of at least 40 HRC on a surface facing the second section of the fastening device.

15. The turbocharger according to claim 1, wherein the flange of the bearing housing is a separate assembly of the bearing housing, produced from a hard or hardened material having a surface hardness of at least 40 HRC and whose body is mounted to the bearing housing by a thread.

16. The turbocharger according to claim 1, wherein the fastening device is segmented in circumferential direction, wherein each segment of the fastening device is mounted with a respective first section of the fastening device on the flange of the turbine housing via maximally two fasteners.

17. The turbocharger according to claim 12, wherein the fastening device is segmented in circumferential direction, wherein each segment of the fastening device is mounted with a respective first section of the fastening device on the flange of the turbine housing via maximally two fasteners, and wherein a circumferential segment width of each segment of the fastening device correspond to a circumferential segment width of ring segments of the second ring, so that between the first ring and each segment of the fastening device a corresponding ring segment of the second ring is arranged.

18. The turbocharger according to claim 17, wherein the circumferential segment width of each segment of the fastening device is equal to the circumferential segment width of ring segments of the second ring.

19. The turbocharger according to claim 1, wherein the first planar face of the fastening device is generally polygonal.

20. The turbocharger according to claim 19, wherein corners of the generally polygonal are rounded.

* * * * *